US005082398A

United States Patent [19]

Subic

[11] Patent Number: 5,082,398

[45] Date of Patent: Jan. 21, 1992

[54] SYSTEM OF VEGETATION STRIPS FOR PROTECTION OF SLOPES AGAINST EROSION

[76] Inventor: Franc Subic, Tretnikova 56, 61000 Ljubljana, Yugoslavia

[21] Appl. No.: 486,505

[22] Filed: Feb. 28, 1990

[30] Foreign Application Priority Data

Mar. 6, 1989 [YU] Yugoslavia ..... 469/89

[51] Int. Cl.[5] ..... E02B 3/04

[52] U.S. Cl. ..... 405/258; 256/12.5; 405/15; 405/16

[58] Field of Search ..... 405/258, 284, 286, 15, 405/19, 16; 256/12.5

[56] References Cited

U.S. PATENT DOCUMENTS 4,279,535 7/1981 Gagliardi et al. ..... 405/15

FOREIGN PATENT DOCUMENTS 560540 7/1923 France ..... 405/15
0016730 2/1981 Japan ..... 405/258
0101932 6/1983 Japan ..... 405/258
0226410 9/1988 Japan ..... 405/258

*Primary Examiner*—Dennis L. Taylor
*Attorney, Agent, or Firm*—Herbert Dubno

[57] ABSTRACT

The subject of the present invention is a system of vegetation strips for protection of slopes against erosion. The system is made with wire netting strips fixed slantwise (at angles ranging between 20° and 40°) to the base wire netting. Wire netting strips 2 are fixed on the base wire netting 1 at distances ranging from 1 m to 3 m. Bottom edges of the wire netting strips 2 are fixed around the base wire netting 1 with wire. Upper edges of the wire netting strips 2 have to be fixed with wire to the points 4 on the base wire netting 1. The "channel" so formed is filled with earth, turf or similar material to allow growth of the vegetation cover.

2 Claims, 2 Drawing Sheets

SYSTEM OF VEGETATION STRIPS FOR PROTECTION OF SLOPES AGAINST EROSION

BACKGROUND OF THE INVENTION

The subject matter of the invention is a system of vegetation strips for protection of slopes against erosion. This kind of protection is used with slopes with inclines ranging from 45° to 65°. The slope and also the space under the slope are efficiently protected against erosion and erosion materials. The vegetation strip system completely prevents erosion of the ground.

The technical problem, which is successfully solved with the present invention, is to retain erosion material on the slope, especially slopes with inclines exceeding 45°.

The known protections of slopes with inclines ranging from 45° to 65° are primarily made with dead materials—concrete walls etc. There also exist protective covers consisting of living vegetative material as the main active protective component and wire netting as a secondary but incomplete protection.

There are several drawbacks to protection of slopes by inorganic materials, e.g. a concrete wall. One drawback is limited life because the material used cannot regenerate. A second drawback is a technical problem posed by cascading mountain water which limits the height of protection. It has also proved impossible to achieve a protection that adheres to the main uneven configuration of the slope. Moreover there is the disadvantage of the additional space is needed at the foot of the slope for the foundation. This kind of protection is also ecologically inappropriate.

Among the protections applying living material there are also the so-called slope mesh and slope support. Slope meshes are of several types, depending on the inclination and the height of the slope. The basic principle of the mesh is to anchor the wooden or concrete mesh to the slope and then put earth into the openings of the mesh. The great volume of the filling material which covers the whole slope becomes a statical problem at a certain slope height. For that reason this kind of protection is appropriate for slopes with limited inclines. Wooden meshes are usually designed for slopes with inclines not exceeding 45°, although there exist special types intended for steeper slopes (intensive filling of vegetative material results in an increase of the angle of internal friction of the filling material), but this kind of protection is limited to heights ranging between 3 and 5 meters with slopes having an incline of 65°.

The concrete type mesh has similar and usually even greater disadvantages. This type is used for consolidation of the ground (slides) rather than for surface protection of steep excavated slopes.

A great disadvantage of all slope meshes is that they do not adhere well to uneven configurations, so their use is limited.

Slope support is used for protection of steep overhanging points but its application is also very limited.

Recently, slopes have been protected with wire or plastic netting. The protection is perfect only in slopes with small inclinations—only operative with in even slopes with inclinations of 60° where the wire netting closely adheres to the slope, where there are not water sources and no large oscillations of daily temperatures (northern side) and where the slope does not contain moisture or is subject to freeze. In complex cases the wire netting is fixed by rock bolts to prevent separation of the netting and to hold the erosion material on the slope. However, the wash away of—especially—small fractions from the slope and constant movement of erosion material under the netting prevents the vegetation cover from developing. On soft slopes, the rock bolts get loose under the pressure of the material accumulated under the netting, so this material slides down the slope, devastating the already growing protection cover of the slope.

All the above mentioned processes are described in the book: Schiechtl, H. M. Sicherungsarbeiten im Landschaftsbau, Munich 1973, on pages 135-136, 197-199 and 208, and also in the publication Forschungsgesellschaft für das Strassenwesen, Arbeitsausschuss Landschaftsgestaltung, 1971; Richtlinien für den Lebendverbau an Strassen, Cologne, page 30.

Also known are vegetation cores for protection of slopes against erosion described in the Yugoslav patent application P 1595/84. Here, the vegetation core is made as follows: Wire netting is spread on the ground. At appropriate distances, pieces of wire netting are fastened to it. The upper edges of the wire netting are fixed with wire to the wire netting below, making pockets which are filled with earth, turf or other vegetation material. Then, shrubs and small trees and planted into it, forming vegetation cores retaining erosion material.

By such vegetation cores the slope is not perfectly protected against erosion in the initial period of vegetation because the filling material moves at points where there are no vegetation cores.

SUMMARY OF THE INVENTION

A system for protection of slopes against erosion is herein disclosed comprising:

- a base wire netting having a longitudinal axis along a major length thereof; and
- a plurality of wire netting strips each having upper and lower edges, the lower edges being fixed along a surface of the base wire netting, the upper edges being connected through a plurality of wires to points along the surface of the base wire netting, and the wire netting strips being oriented slantwise along a length thereof at an angle ranging between 20° and 40° relative to the longitudinal axis of the base wire netting to thereby form a plurality of channels.

BRIEF DESCRIPTION OF THE DRAWING

The vegetation strip system under the present invention will be described with an example and with fingers showing the following.

DETAILED DESCRIPTION

Figure 1:
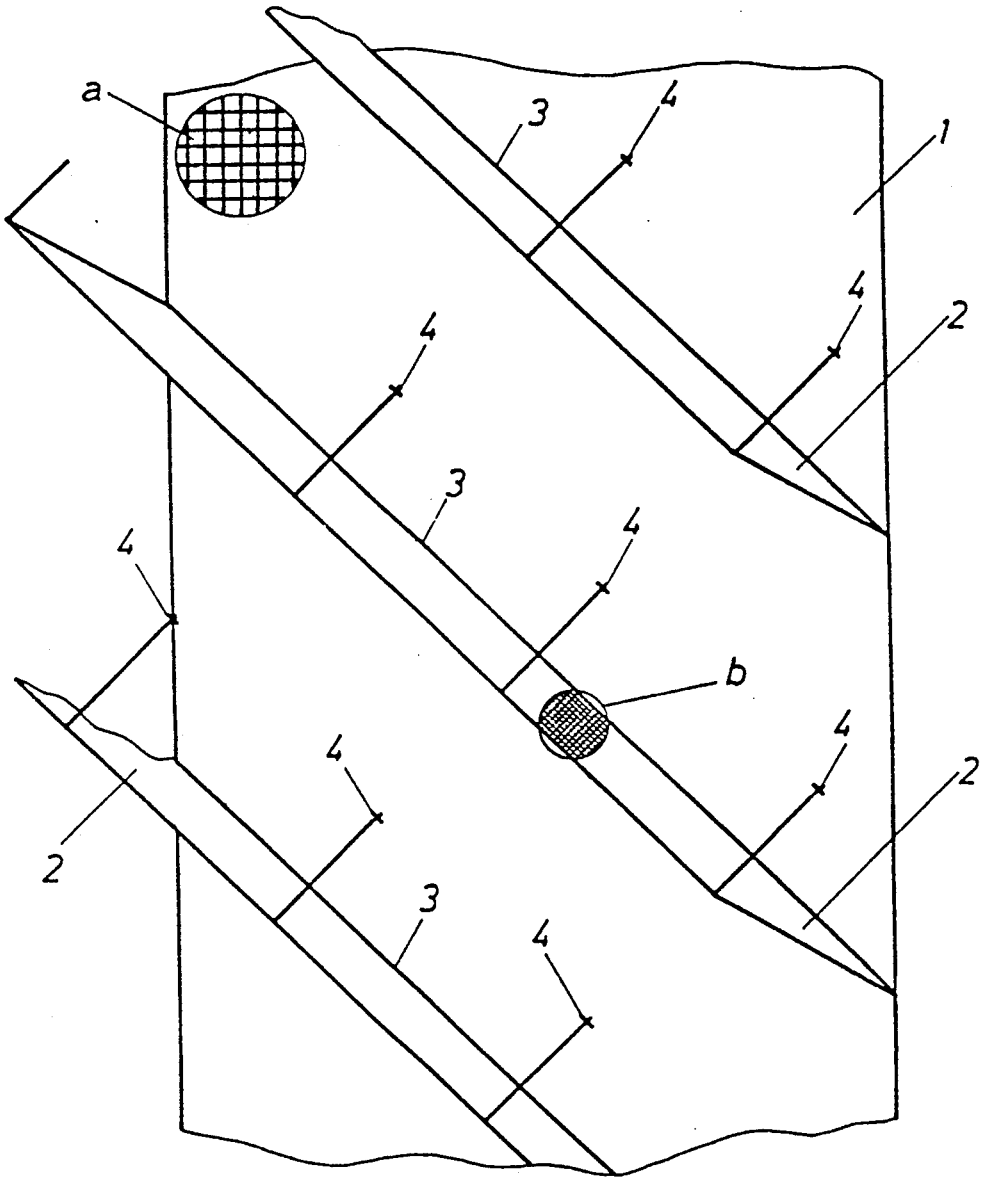
FIG. 1—Diagrammatic presentation of base wire netting 1 with fixed wire netting strips 2 according to the invention.

The vegetation strip system of the invention prevents erosion in the area around and along the vegetation strips rendering it possible for the vegetation cover to develop full growth. The base wire netting 1 is shown in FIG. 1. On the base wire netting 1 whose mesh is shown in detail "a", wire netting strips 2 are fixed at similar distances (between 1 to 3 m). The mesh of the wire netting 2 is shown in detail "b".

Wire netting strip 2 is fixed to the base wire netting 1 with a wire 3 which is twisted around the base netting 1 and the bottom edge of the wire netting strip 2. Fixed on the upper edge of the wire netting strip 2 are wires which are fixed to the base netting 1 at points 4. The above structure can be prefabricated, made on site or combinedly.

The vegetation strip system under the invention is installed as follows:

Base wire netting 1 is spread on the slope and fastened at the top of the slope. In case of uneven slope configuration base wire netting 1 must be fixed by rock bolts also at the uneven points to adhere to the ground. Individual strips of base wire netting 1 are also fixed to each other, so the slope is completely covered with base wire netting 1, with the bottom edge of wire netting 2 fixed to the base wire netting 1 with wire 3.

Figure 2:
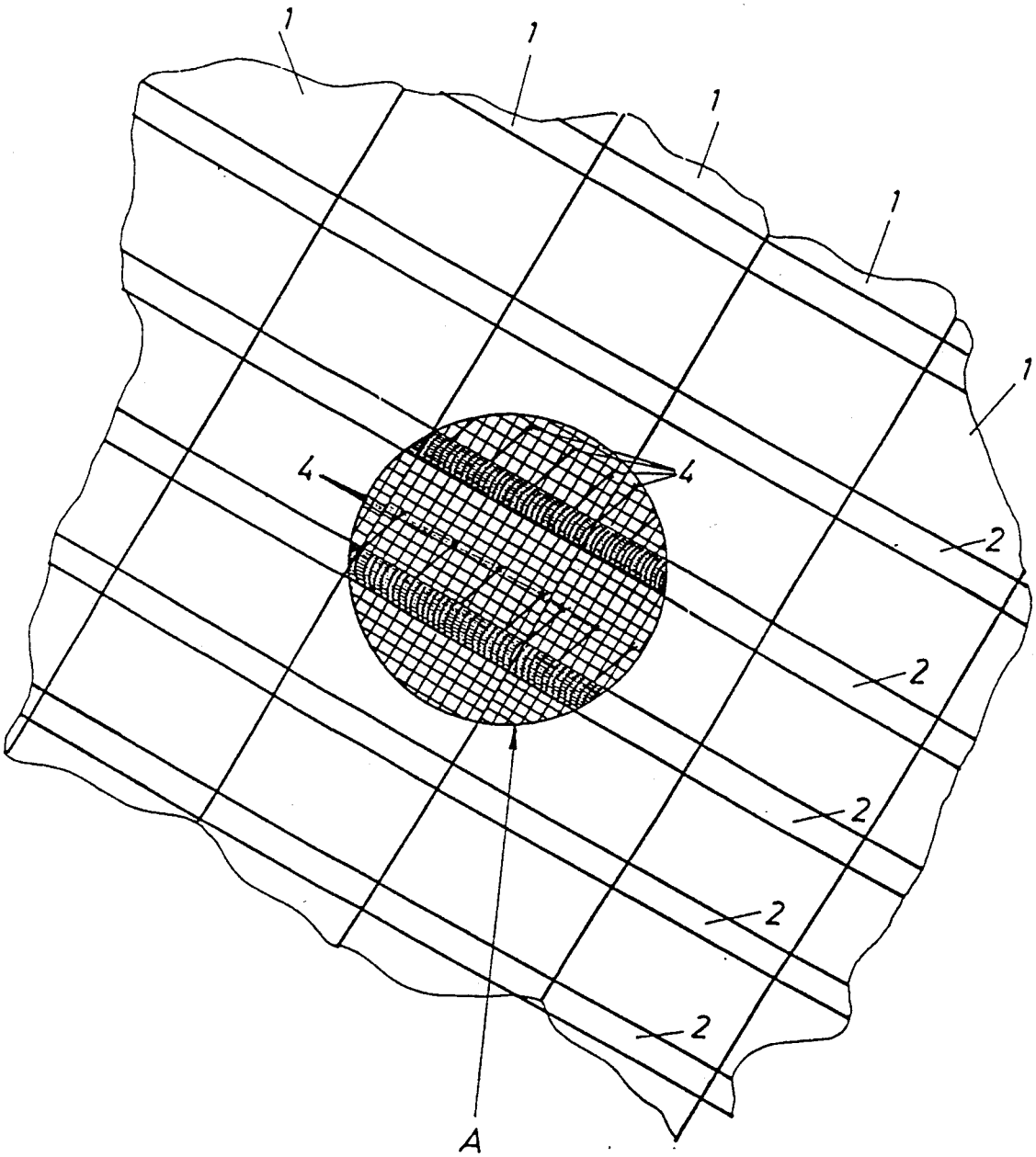
FIG. 2—Diagrammatic presentation of the complete system of vegetation strips for protection of slopes against erosion according to the invention.

As shown in FIG. 1 and FIG. 2, the strips of wire netting 2 are fixed to the base wire netting 1 slantwise, under an angle of 20° to 40° to the bottom line of the slope.

Such installation of wire netting strips 2 provides better adherence to the uneven surface of the slope (usually these are furrows going down the slope in the direction of the roadway) and essentially easier performance of all subsequent works on the slope (each strip of wire netting 2 ends at the bottom of the slope).

Then, upper edges of wire netting strips 2 are fixed with wire to the points 4 on the base wire netting 1. The channel so formed is set apart with special spacers and then filled with earth, turf or other similar material. If necessary, the front side of this channel is closed with synthetic material, jute or similar material to prevent the wash away of earth. This procedure starts at the top of the slope and continues slowly downwards to the bottom. The vegetation strip is then completed.

Small trees and shrubs are then planted or seeded into the vegetation strips to ensure continued development of vegetation which will protect the slope.

With this protection system, the slope is exposed only to such loads (of earth or other filling material) as are absolutely necessary for further development of the vegetation strips. Vegetation strips hold erosion material, whereas the filling material is held first by the force of friction between the base wire netting 1 and the surface of the slope and later by the roots of the plants.

Due to these advantages, slopes with inclines ranging from 45° to 65° can be protected with no height limit.

One further advantage is the tight adherence of the protection system to the configuration of any slope. Overhanging and protuberance points can be covered by corresponding installation of the wire netting strips.

Planting or seeding does not depend on the vegetation period as it is the case with the "slope mesh"; this operation can be done subsequently. In addition, this slope protection system has unlimited life and meets environmental requirements.

We claim:

1. A system for protection of slopes against erosion, comprising:

a base wire netting having a longitudinal axis along a major length thereof; and a plurality of wire netting strips each having upper and lower edges, said lower edges being fixed along a surface of said base wire netting, said upper edges being connected through a plurality of wires to points along said surface of said base wire netting, and said wire netting strips being oriented slantwise along a length thereof at an angle ranging between 20° and 40° relative to said longitudinal axis of said base wire netting to thereby form a plurality of channels.

2. A system according to claim 1 wherein said channels are filled with a material selected from the group consisting of earth and turf, to allow growth of a vegetation cover.

* * * * *